US008702091B2

(12) United States Patent
Schmidt et al.

(10) Patent No.: US 8,702,091 B2
(45) Date of Patent: Apr. 22, 2014

(54) PRINTING STOCK FEEDER

(76) Inventors: James P. Schmidt, Omaha, NE (US); Jeffrey Schmidt, Lincoln, NE (US)

( * ) Notice: Subject to any disclaimer, the term of this patent is extended or adjusted under 35 U.S.C. 154(b) by 0 days.

(21) Appl. No.: 13/114,625

(22) Filed: May 24, 2011

(65) Prior Publication Data

US 2012/0299235 A1 Nov. 29, 2012

(51) Int. Cl.
*B65H 5/00* (2006.01)
*B65H 1/02* (2006.01)

(52) U.S. Cl.
USPC ..... 271/150; 271/153; 271/152; 271/10.06

(58) Field of Classification Search
USPC ..... 271/150–155, 167, 3.03, 3.06, 3.09
See application file for complete search history.

(56) References Cited

U.S. PATENT DOCUMENTS 3,260,521 A 7/1966 Moxness
4,192,496 A * 3/1980 Baselice et al. ..... 271/10.07
4,512,562 A * 4/1985 Moll ..... 270/45
4,607,834 A 8/1986 Dastin
4,911,421 A * 3/1990 Hannon ..... 271/161
5,000,435 A * 3/1991 Godlewski ..... 271/10.09
5,002,267 A 3/1991 Brecy
5,033,729 A * 7/1991 Struthers ..... 271/10.06
5,167,408 A * 12/1992 Golicz ..... 271/149
5,255,903 A * 10/1993 Parsons et al. ..... 271/10.12
5,494,272 A * 2/1996 Golicz ..... 271/3.03
6,142,462 A * 11/2000 Moser et al. ..... 271/157
6,142,689 A 11/2000 Margiotta
6,467,764 B1 * 10/2002 Stevens ..... 271/4.01
7,077,397 B2 * 7/2006 Stevens ..... 271/149
7,523,929 B2 * 4/2009 Surprise et al. ..... 271/126
7,624,978 B2 * 12/2009 Kaiping ..... 271/35
2002/0089114 A1 * 7/2002 Ford et al. ..... 271/157
2003/0025266 A1 * 2/2003 Stevens ..... 271/149
2011/0291348 A1 * 12/2011 Kaiping ..... 271/10.06

* cited by examiner

*Primary Examiner* — Kaitlin Joerger
(74) *Attorney, Agent, or Firm* — Suiter Swantz pc llo

(57) ABSTRACT

A printing stock feeder system may include, but is not limited to: a support stand; a feed deck rotatably coupled to the support stand; a printing stock storage stack; and a printing stock transfer mechanism.

9 Claims, 10 Drawing Sheets

PRINTING STOCK FEEDER

BACKGROUND

Feeder systems for high-volume printing may include stand-alone devices configured to provide printing stock storage capacity in excess of standard tray capacities of printing devices.

SUMMARY

A printing stock feeder system may include, but is not limited to: a support stand; a feed deck rotatably coupled to the support stand; a printing stock storage stack; and a printing stock transfer mechanism.

BRIEF DESCRIPTION OF THE DRAWINGS

Figure Number:

1 shows a printing stock feeder system adjacent to a printing system;

Figure 1:
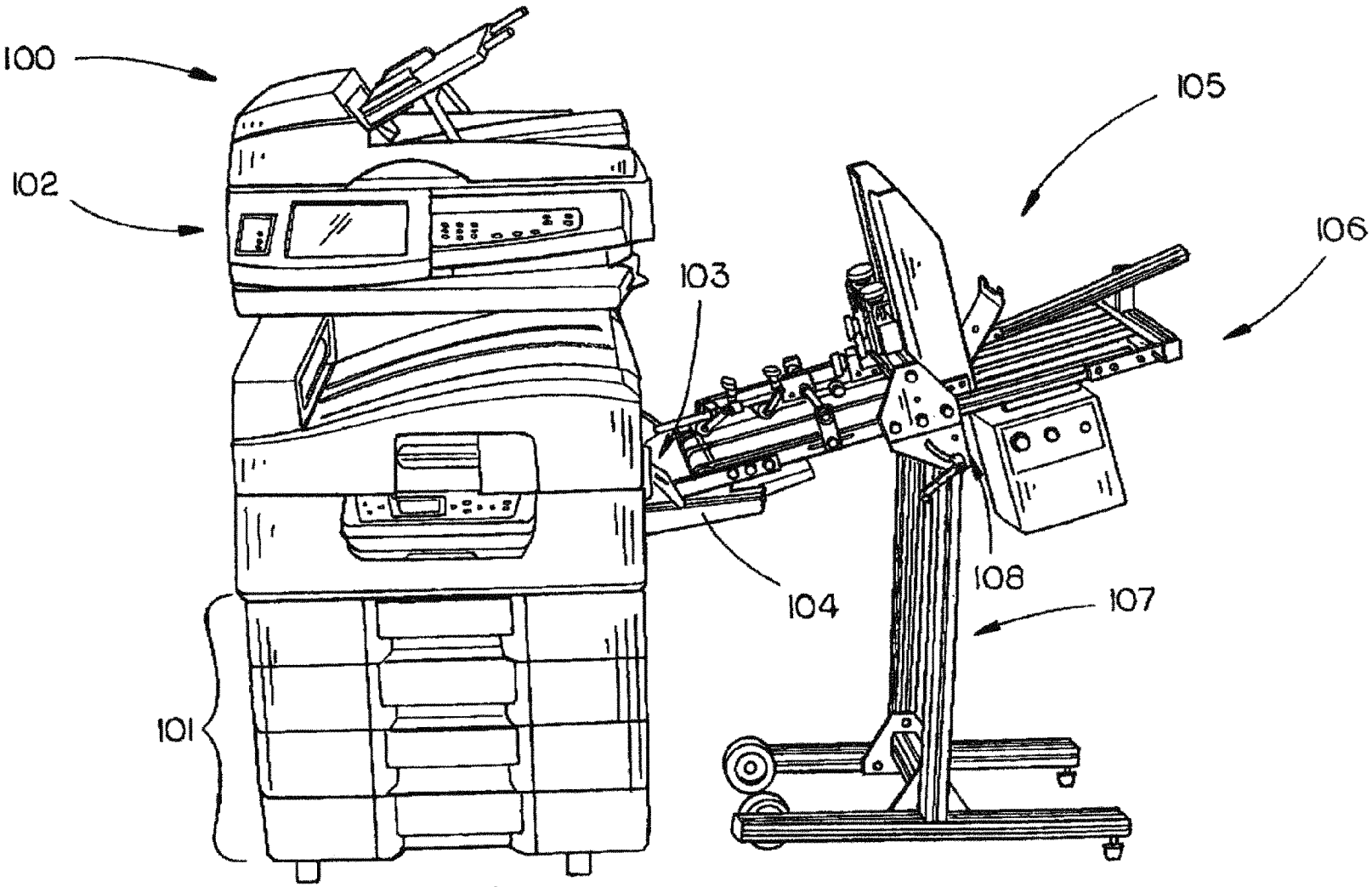

2 shows a side perspective view of a printing stock feeder system;

3 shows a rear perspective view of a printing stock feeder system;

4 shows a front perspective view of a printing stock feeder system;

5 shows a front perspective view of a printing stock feeder system;

6 shows a rear perspective view of a printing stock feeder system;

7 shows a cross-sectional view of a printing stock feeder system;

8 shows a cross-sectional view of a printing stock feeder system;

9A shows a cross-sectional view of a printing stock feeder system;

9B shows a cross-sectional view of a printing stock feeder system;

10A shows a cross-sectional view of a lever portion of a printing stock feeder system;

10B shows a cross-sectional view of a lever portion of a printing stock feeder system;

10C shows a cross-sectional view of a lever portion of a printing stock feeder system.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

A printing system 100 may include printing stock storage trays 101 from which various types of printing stock (e.g. paper, envelopes, and the like). Such storage trays 101 are often disposed below the printer 102 of the printing system 100 so printing stock from such storage trays 101 may be fed to a printing system in a "top-down" manner such that additional printing stock cannot be added to the storage trays 101 without halting operations. Such storage trays 101 may have finite capacities.

The printing system 100 may also include a single-sheet auxiliary feeder 103 including a feed tray 104 located to one side of the printing system 100. The single-sheet auxiliary feeder 103 may be used for low-volume print projects where sheets may be fed by hand. However, as the single-sheet auxiliary feeder 103 is located on the exterior of the printing system 100, it does not require halting operations to add printing stock for continued printing.

As such, it may be desireable to provide a stand-alone feeder system configured to continuously provide printing stock to the single-sheet auxiliary feeder 103 of the printing system 100.

Referring to FIG. 1, a printing stock feeder system 105 is shown. The feeder system 105 may include a feed deck 106 rotatably coupled to a support stand 107. The feed deck 106 may be configured to rotate relative to the support stand 107 about pivot point 108.

Figure 2:
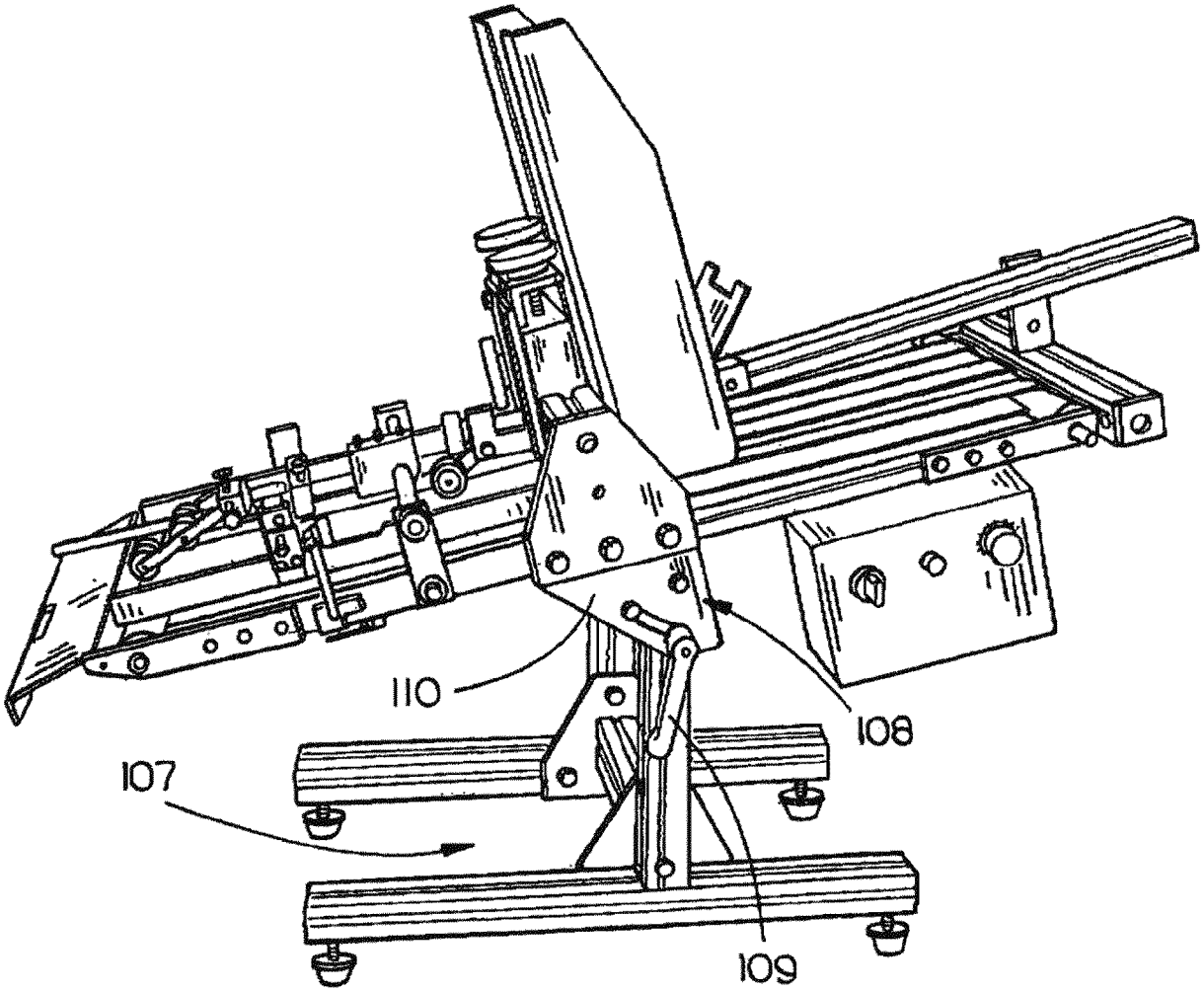

Referring to FIG. 2, the feeder system 105 may include a locking mechanism 109 (e.g. a friction knob) configured to engage a surface of a projection 110 extending from the feed deck 106 so as to lock the feed deck 106 in a desired rotational position relative to the support stand 107.

Figure 3:
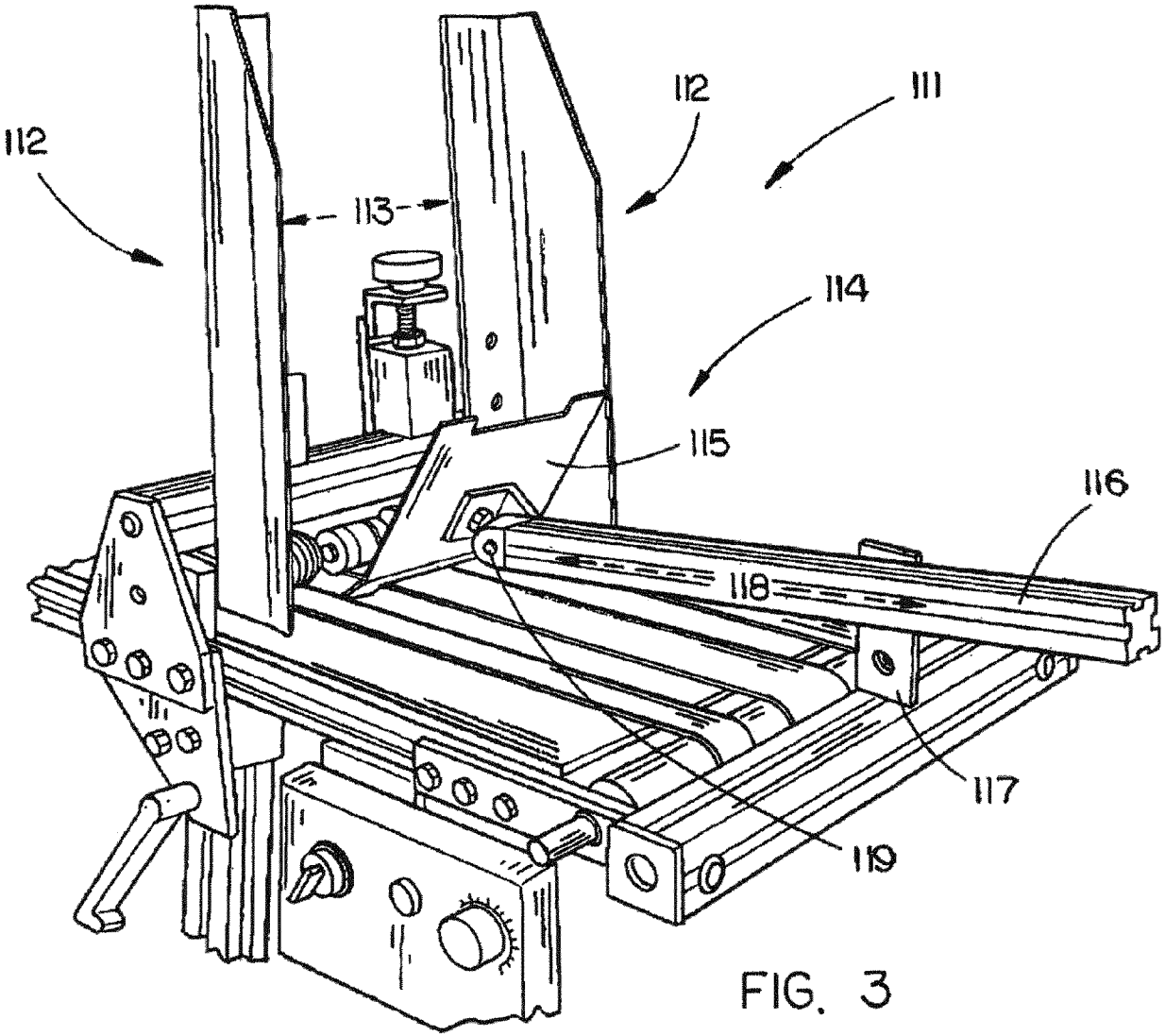

Referring to FIG. 3, the feeder system 105 may include a printing stock storage stack 111. The storage stack 111 may include one or more bracket portions 112. The bracket portions 112 may be laterally adjustable 113 so as to receive any sized printing stock. The storage stack 111 may further include a printing stock support portion 114. The support portion 114 may include a support plate 115 and a support arm 116. The the support arm 116 may be coupled to a support bracket 117. The support arm 116 may be adjustably coupled to the support bracket 117 in order to allow for the translation 118 of the support plate 115 toward or away from the support bracket 117 so as to accommodate any sized printing stock. The support plate 115 may be coupled to the support arm 116 at a pivot point 119 such that an angle of incidence of a sheet of printing stock with respect to the feed deck 106 may be optimized to facilitate efficient withdrawal of the sheet of printing stock from the storage stack 111.

Figure 4:
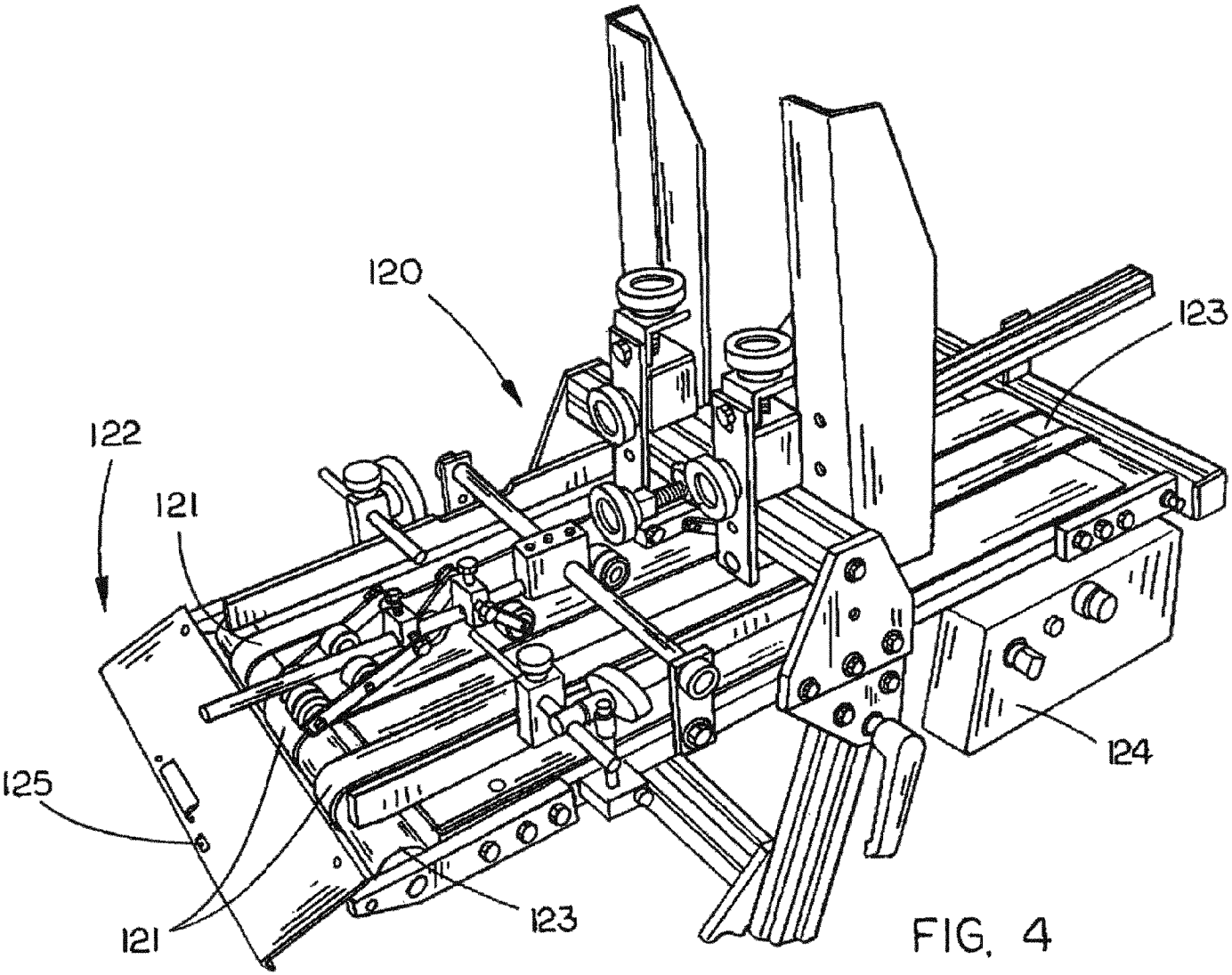

Referring to FIG. 4, the feeder system 105 may include a printing stock transfer mechanism 120. The printing stock transfer mechanism 120 may include one or more belts 121 configured to move along a surface of the feed deck 106, thereby transferring a sheet of printing stock from the storage stack 111 to an output position 122 near the front of the feeder system 105 where the sheet of printing stock may be drawn into an auxiliary feeder 103 of a printing system 100. The printing stock transfer mechanism 120 may include one or more rollers 123 configured to facilitate the movement of the belts 121 during operation. The rollers 123 may be at least partially disposed within the plane of the feed deck 106 so as to maintain the belts 121 in contact with the feed deck 106 during operation. The printing stock transfer mechanism 120 may include a motor 124 configured to drive the belts 121 during operation. The motor 124 may be operably coupled to a drive roller (not shown) configured to contact the belts 121 so as to move the belts along the feed deck 106. The drive roller may be a stand-alone roller located beneath the feed deck 106 (not shown) or may be one of the rollers 123. The motor 124 may include electrical circuitry enabling the motor 124 to be operated in multiple modes (e.g. automatic feeding, manual feeding, etc.). The motor 124 may be a variable speed motor allowing for a user to adjust the speed of the transfer of printing stock between the storage stack 111 and the output position 122 to coincide with an intake rate of the auxiliary feeder 103 of the printing system 100.

The printing stock transfer mechanism 120 may further include a vaccum system (not shown). The vaccum system may be configured to draw a vaccum through one or more apertures (not shown) in the feed deck 106 and/or the belts 121. The apertures may be disposed beneath the storage stack 111 and configured to apply a vaccum to a sheet of printing stock 134 located in the storage stack 111. The application of the vaccum to the sheet of printing stock 134 with the vaccum system may serve to draw the sheet of printing stock 134 against the belts 121 to further facilitate transfer of the sheet of printing stock 134 out of the storage stack 111 and along a surface of the feed deck 106.

The printing stock transfer mechanism 120 may further include a printing stock transfer regulation system. The printing stock transfer regulation system may serve to regulate the operations of the motor 124 (e.g. speed, timing, direction) in transferring printing stock between the storage stack 111 and the output position 122. The printing stock transfer regulation system may include a printing stock proximity sensor 125 (e.g. an optical sensor) operably coupled to detection circuitry (e.g. applicant specific integrated circuitry, a generally purpose processor, etc.) that may detect whether or not a sheet of printing stock has been positioned over the sensor 125. The detection circuitry may be operably coupled to motor control circuitry such that the operations of the motor 124 are controlled by whether or not the sensor 125 and detection circuitry detect the presence or absence of a sheet of printing stock over the sensor 125. For example, where a sheet of printing stock is not detected over the sensor 125, the detection circuitry may cause the motor 124 to engage to draw a sheet of printing stock toward the output position 122. Upon detection of a sheet of printing stock over the sensor 125, the detection circuitry may cause the motor 124 to disengage. Once an auxiliary feeder 103 of printing system 100 withdraws the sheet of printing stock from the output position 122, the process may repeat with a subsequent sheet of printing stock.

Figure 5:
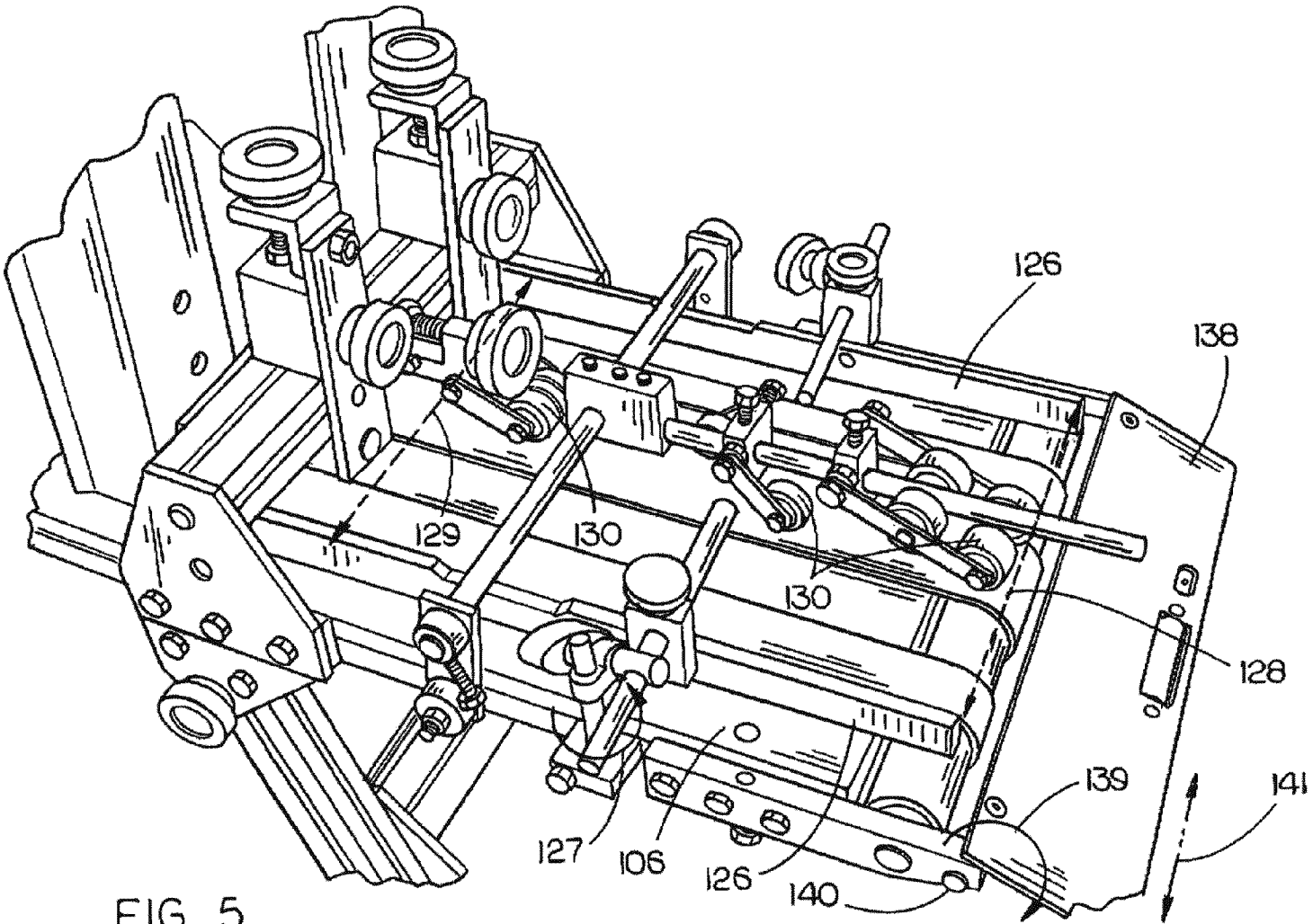

Referring to FIG. 5, the feeder system 105 may include one or more printing stock guides 126. The printing stock guides 126 may be configured to maintain printing stock in a desired orientation as it moves between the storage stack 111 and the output position 122. The printing stock guides 126 may be adjustable to accept any printing stock size. The printing stock guides 126 may be laterally adjustable across the width of the feed deck 106. The printing stock guides 126 may be rotatably adjustable such that a distance between the printing stock guides 126 may vary between the storage stack 111 and the output position 122. For example, the printing stock guides 126 may be configured so as to rotate 127 slightly inward such that a distance 128 between the printing stock guides 126 is less at the output position 122 than a distance 129 between the printing stock guides 126 at the storage stack 111.

The feeder system 105 may include one or more compression rollers 130. The compression rollers 130 may be spring-loaded or otherwise weighted to apply a downward force against the feed deck 106. Such downward force may facilitate transfer of printing stock by the belts 121 by maintaining sufficient frictional contact between the printing stock and the belts 121 during transfer. The compression rollers 130 may be configured such that they are disposed directly on top of the belts 121 in order to provide optimal contact between a sheet of printing stock and the belts 121. The compression rollers 130 may be adjustable along and/or removable from the length of the feed deck 106 to accommodate any size of printing stock.

Figure 6:
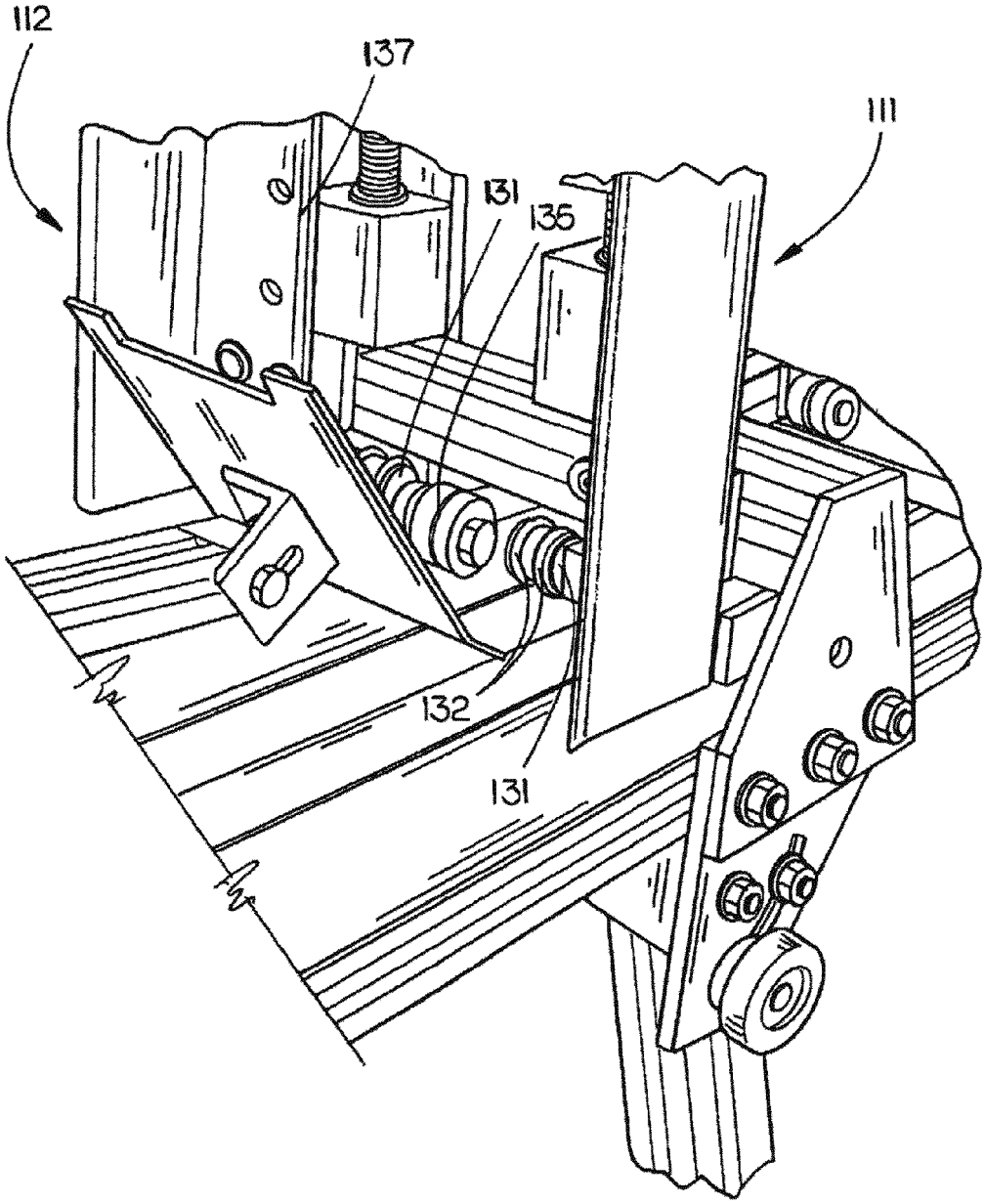

Referring to FIG. 6, the feeder system 105 may include one or more printing stock stops 131. The printing stock stops 131 may be disposed adjacent to the storage stack 111. The printing stock stops 131 may include one or more o-ring portions 132.

Figure 7:
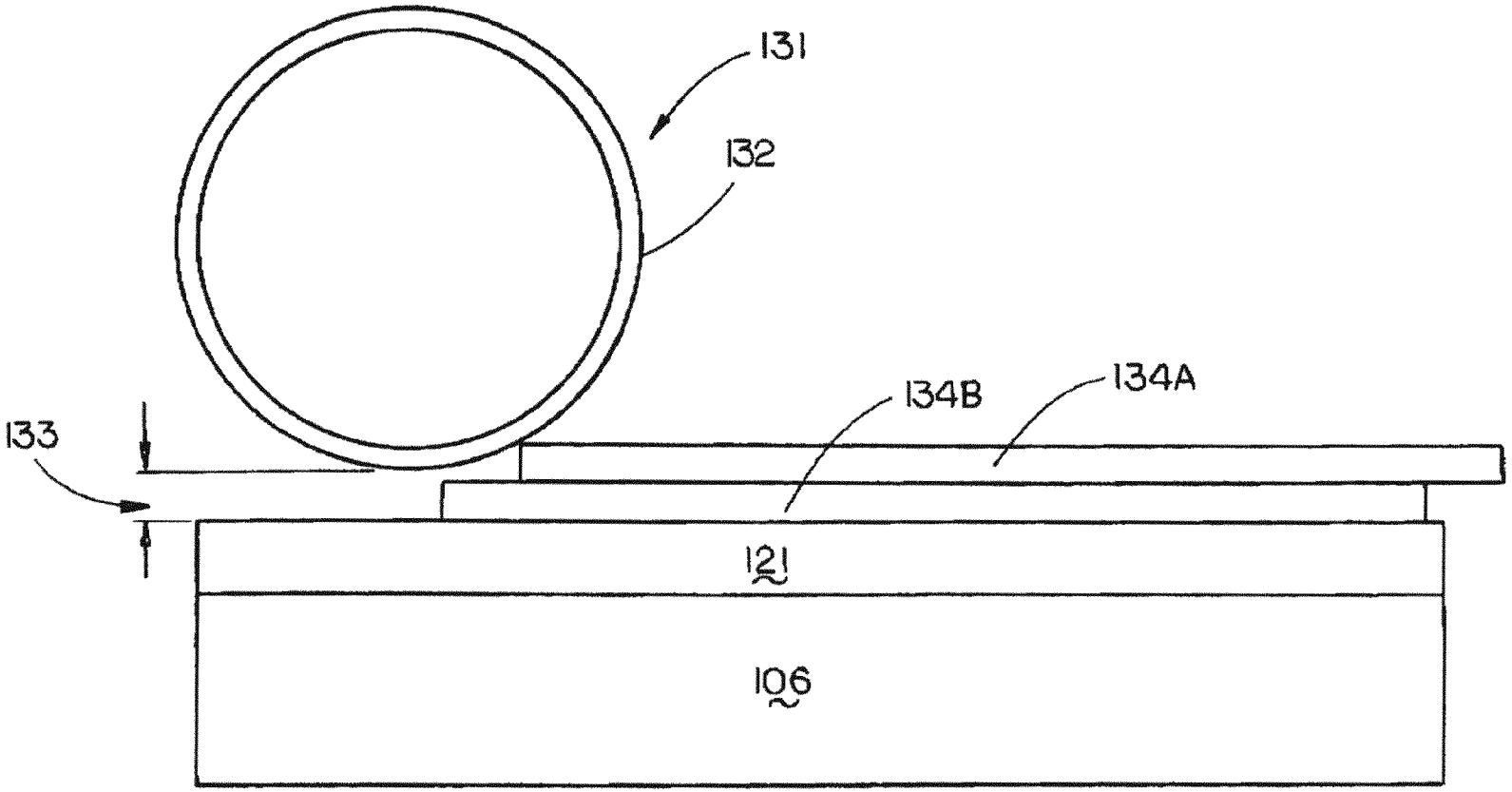

Referring to FIG. 7, the printing stock stops 131 may be elevated a distance 133 above the feed deck 106. The printing stock stops 131 may be configured to physically engage a first sheet of printing stock 134A which is disposed atop a second sheet of printing stock 134B. The o-ring portions 132 may be constructed of a material having a high coefficient of friction (e.g. rubber) such that the frictional forces existing between the o-ring portions 132 and the first sheet of printing stock 134A is greater than the frictional forces existing between the first sheet of printing stock 134A and the second sheet of printing stock 134B. When the belts 121 engage the second sheet of printing stock 134B for removing it from the storage stack 111, the printing stock stops 131 may retain the first sheet of printing stock 134A in place within the storage stack 111 due to the frictional force differential between the printing stock stops 131 and the first sheet of printing stock 134A and the first sheet of printing stock 134A and the second sheet of printing stock 1348.

Figure 8:
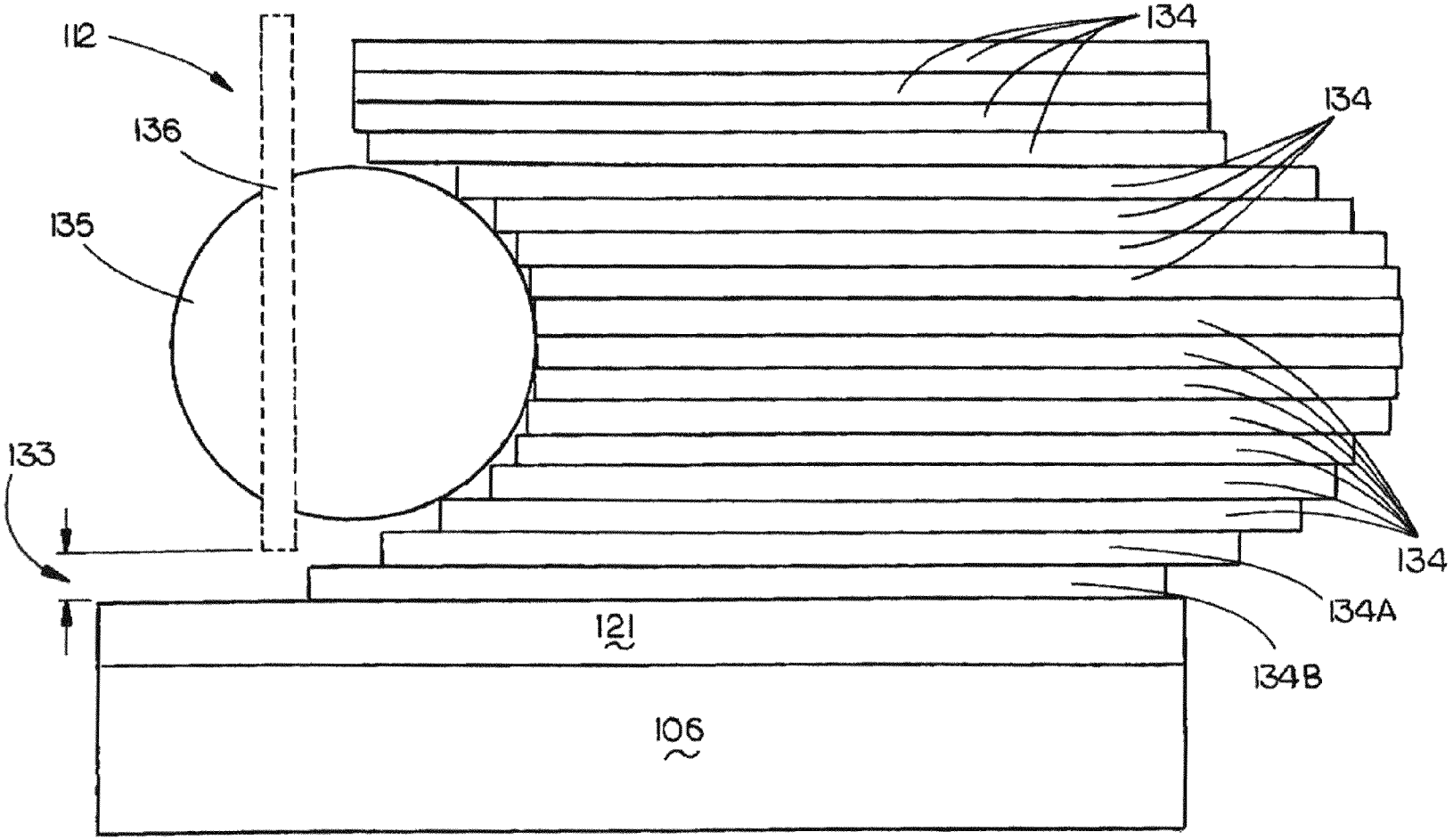

Referring again to to FIG. 6, the feeder system 105 may include one or more pre-separation rollers 135. Referring to FIGS. 6 and 8, the pre-separation rollers 135 may be configured such that it at least partially intersects a plane 136 defined by a front portion 137 of the bracket portions 112 of the storage stack 111. Referring to FIG. 8, in such a configuration, as sheets of printing stock 134 move down through the storage stack 111 as sheets of printing stock 134 are removed from the bottom of the storage stack 111, the pre-separation rollers 135 may displace at least a portion of a first sheet of printing stock 134A in a lateral direction relative to a first sheet of printing stock 134B. Such displacement may serve to reduce the frictional forces exising between the first sheet of printing stock 134A and the second sheet of printing stock 134B. Further, such displacements of the sheet of printing stock 134 may serve to ensure that sheets of printing stock 134 are provided to the printing stock stops 131 one at a time, thereby reducing the potential of jamming and/or multifeeding resulting from multiple sheets of printing stock 134 reaching the printing stock stops 131 simultaneously.

Referring again to FIG. 5, the feeder system 105 may include an articulating lever portion 138. The lever portion 138 may rotate 139 relative to a front edge of the feed deck 106 about a pivot point 140. The lever portion 138 may rotate into positions above and/or below a plane defined by the feed deck 106. The lever portion 138 may be affixed in a static position relative to the plane of the feed deck 106. Alternate, the lever portion 138 may be allowed to float freely between varying positions 141 relative to the plane of the feed deck 106 so as to move in conjunction with movements of an articulating feed tray 104 of an auxiliary feeder 103.

Figure 9A:
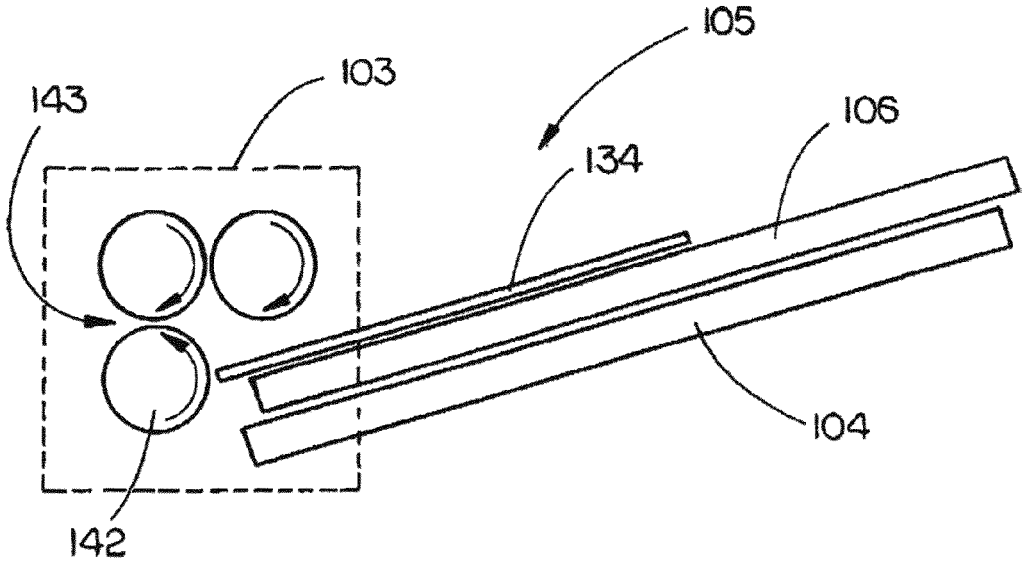

The articulation of the lever portion 138 in combination with the rotation of the feed deck 106 with respect to the support stand 107 (as shown in FIG. 1) may provide for optimized acess to an auxiliary feeder 103. As shown in FIG. 1, it may be the case that the auxiliary feeder 103 includes feed tray 104 for insertion of sheets of printing stock by hand. It may be the case that removal of such a feed tray 104 may result in voidance of a warranty contract with the vendor of the printing system 100. However, the relative geometries of the auxiliary feeder 103 and the feed tray 104 may result in non-optimal access opportunites for a stand-alone printing stock feeder. For example, as shown in FIG. 9A, a feed deck 106 of a feeder system 105 without the lever portion 138 may direct a sheet of printing stock 134 toward a feed roller 142 of the auxiliary feeder 103. The configuration of the feed tray 104 may restrict the angle at which the feed deck 106 may approach the feed roller 142 of the auxiliary feeder 103. As such, a sheet of printing stock 134 may be directed below an intake aperture 143 of the auxiliary feeder 103 thereby contacting the feed roller 142 at a high angle of incidence. Such a configuration may result in jamming and/or misfeeding of the sheet of printing stock 134.

Figure 9B:
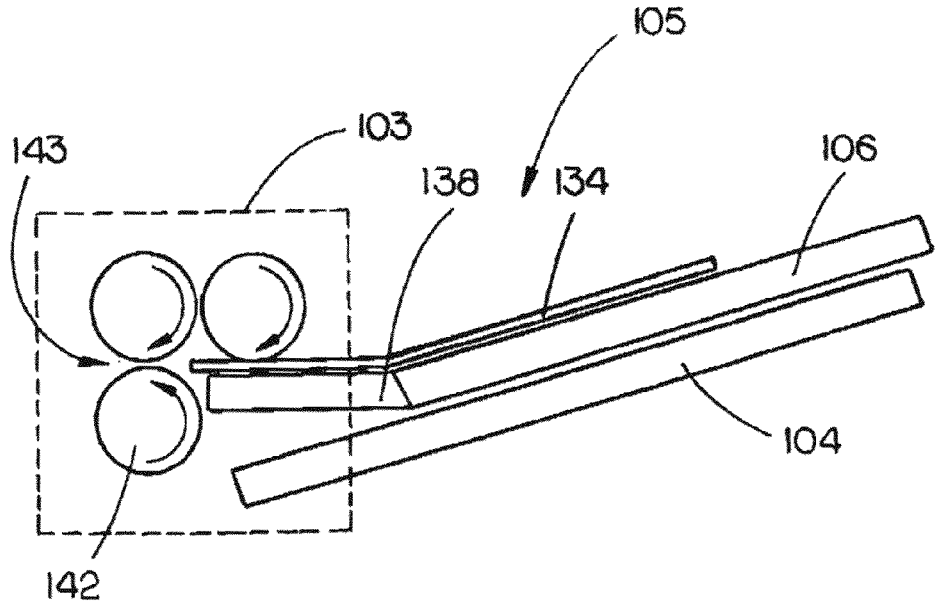

Alternately, as shown in FIG. 9B, a feed deck 106 of a feeder system 105 including the lever portion 138 may direct a sheet of printing stock 134 toward a feed roller 142 of the auxiliary feeder 103. While the configuration of the feed tray 104 may restrict the angle at which the feed deck 106 may approach the feed roller 142 of the auxiliary feeder 103, the lever portion 138 may serve to redirect the sheet of printing stock 134 more directly toward the intake aperture 143 of the auxiliary feeder 103 minimizing the potential for jamming and/or misfeeding of the sheet of printing stock 134.

Figure 10A:
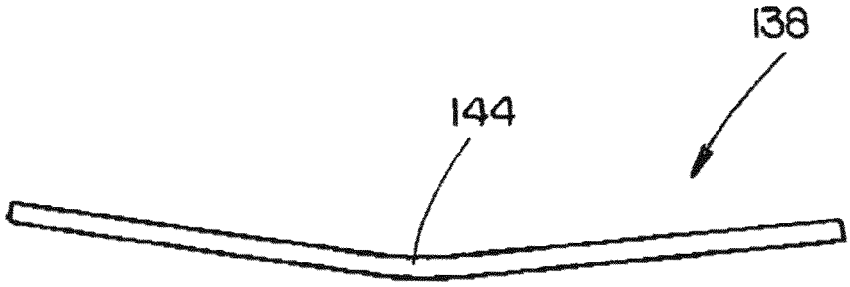
Figure 10B:
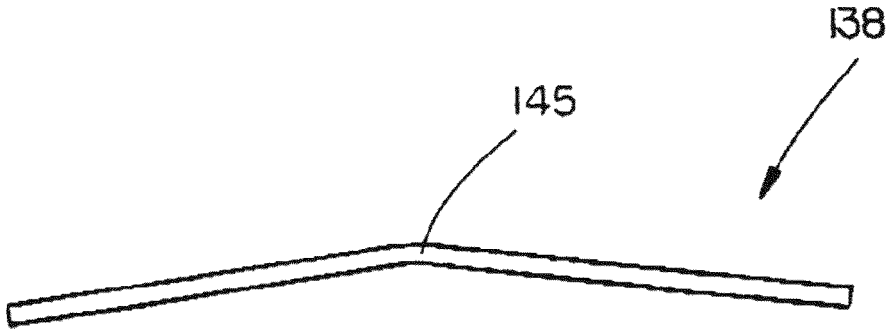
Figure 10C:
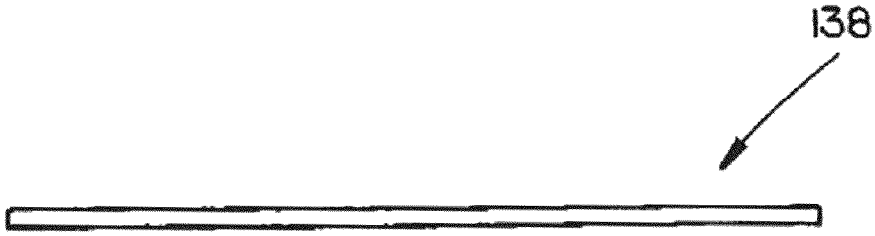

Referring to FIGS. 10A-10C, the lever portion 138 may have a variety of geometric shapes. For example, as shown in FIG. 9A, the lever portion 138 may have an at least partially arcuate portion 144 resulting in an upwardly projecting geometry relative to the feed deck 106. Alternately, as shown in FIG. 9B, the lever portion 138 may have an at least partially arcuate portion 145 resulting in a downwardly projecting geometry relative to the feed deck 106. Such arcuate portions may impart a slight flex in a sheet of printing stock thereby enhancing the rigidity of that sheet and facilitating acceptance of that sheet within an auxiliary feeder 103. Alternately, as shown in FIG. 10C, the lever portion 138 may have a generally planar geometry.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein.

Although specific dependencies have been identified in the claims, it is to be noted that all possible combinations of the features of the claims are envisaged in the present application, and therefore the claims are to be interpreted to include all possible multiple dependencies. It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed is:

1. A sheet stock feeder system comprising:
a support stand;
a feed deck rotatably coupled to the support stand;
a lever portion rotatably coupled to the feed deck at an output position of the feed deck, wherein the lever portion includes an at least partially arcuate portion;
a stock storage stack; and
a stock transfer mechanism.

2. The system of claim 1, wherein the arcuate portion forms an upwardly projecting geometry relative to the feed deck.

3. The system of claim 1, wherein the arcuate portion forms a downwardly projecting geometry relative to the feed deck.

4. The system of claim 1, wherein the sheet stock transfer mechanism includes:
one or more belts configured to traverse a surface of the feed deck;
one or more rollers disposed at least partially within a plane defined by the feed deck and configured to engage the one or more belts; and
at least one motor configured to drive the one or more belts.

5. The system of claim 4, further comprising: a sheet stock transfer regulation system.

6. The system of claim 5, wherein the sheet stock transfer regulation system comprises:
at least one sheet stock proximity sensor;
stock detection circuitry configured to detect whether or not a sheet of sheet stock has been positioned over the at least one sheet stock proximity sensor; and
motor control circuitry configured to control operations of the at least one motor according to the presence or absence of a sheet of sheet stock over the sheet stock proximity sensor.

7. A sheet stock feeder system comprising:
a support stand;
a feed deck rotatably coupled to the support stand;
a lever portion rotatably coupled to the feed deck;
a sheet stock storage stack including one or more bracket portions;
a sheet stock transfer mechanism and;
one or more unpowered pre-separation rollers, wherein the one or more pre-separation rollers at least partially intersect a plane defined by a front portion of the one or more bracket portions.

8. The system of claim 7, wherein the pre-separation rollers displace at least a first sheet of sheet stock relative to a second sheet of sheet stock while the first sheet of sheet stock and the second sheet of sheet stock are disposed within the sheet stock storage stack.

9. The system of claim 1, further comprising:
two or more stock guides, wherein one or more of the sheet stock guides are rotatably adjustable such that a distance between the sheet stock guides may vary between the sheet stock storage stack and the output position of the feed deck.

* * * * *